United States Patent [19]

Morey et al.

[11] Patent Number: 4,736,781

[45] Date of Patent: Apr. 12, 1988

[54] STUMP DISINTEGRATOR

[75] Inventors: Norval K. Morey, Weidman; Ivor Bateman, Mt. Pleasant, both of Mich.

[73] Assignee: Morbark Industries, Inc., Winn, Mich.

[21] Appl. No.: 900,448

[22] Filed: Aug. 26, 1986

[51] Int. Cl.[4] ..... B02C 7/12; B27C 1/14

[52] U.S. Cl. ..... 144/176; 144/162 R; 144/241; 144/242 R; 241/92; 241/298; 407/41; 407/46

[58] Field of Search ..... 241/92, 298; 407/41, 407/46, 49; 144/162 R, 176, 172, 174, 241, 242 R

[56] References Cited

U.S. PATENT DOCUMENTS

| | | | |
|---|---|---|---|
| Re. 31,048 | 10/1982 | Smith | 241/281 |
| 384,763 | 6/1888 | Hayes . | |
| 2,034,951 | 3/1936 | McArdle et al. | 83/62 |
| 2,712,842 | 7/1955 | Fahrni | 144/162 |
| 2,936,008 | 4/1957 | Brown | 144/162 |
| 3,144,995 | 8/1964 | Fontaine | 241/298 |
| 3,524,485 | 8/1970 | Smith | 144/176 |
| 3,542,302 | 11/1970 | Salzmann, Jr. | 241/92 |
| 3,559,898 | 2/1971 | Rinke | 241/101 |
| 3,570,773 | 3/1971 | Schneider et al. | 241/81 |
| 3,661,333 | 5/1972 | Smith | 241/281 |
| 3,861,602 | 1/1975 | Smith | 241/92 |
| 3,863,848 | 2/1975 | Mashuda | 241/101 |
| 3,913,643 | 10/1975 | Lambert | 144/172 |
| 3,955,765 | 5/1976 | Gaitten | 241/28 |
| 4,057,192 | 11/1977 | Smith | 241/92 |
| 4,078,590 | 3/1978 | Smith | 144/176 |
| 4,184,526 | 1/1980 | Hanaya | 144/235 |
| 4,254,874 | 3/1981 | Arnoldsson et al. | 209/3 |
| 4,346,744 | 8/1982 | Beer et al. | 241/92 |

FOREIGN PATENT DOCUMENTS

| | | |
|---|---|---|
| 829043 | 10/1977 | U.S.S.R. . |
| 654214 | 10/1977 | U.S.S.R. . |
| 729056 | 12/1977 | U.S.S.R. . |

*Primary Examiner*—W. Donald Bray

*Attorney, Agent, or Firm*—Price, Heneveld, Cooper, DeWitt & Litton

[57] ABSTRACT

The specification describes a stump chipping disintegrator wherein stumps are received in a trough having a rotatable chipping disc at one end and a powered ram plate at the other, the ram plate having diagonally extending penetrators. A stump stabilizer anvil adjacent the disc projects radially inwardly of the trough. The disc has steel, wood slicing blades at the radially inner portion thereof, mounted at a small acute angle to the face of the disc toward the direction of rotation, and carbide chopping blades at the radially outer portion thereof, mounted at a large acute angle to the face of the disc toward the direction of rotation. At least the carbide blades are mounted in special holders removable from the disc. The carbide blades have backup wedge elements that extend substantially the width of the blade at its outer end and extend substantilly to the radial outer edge of the blade. Wood chips sliced off by the steel blades and chips chopped off by the carbide blades all pass through the disc to be propelled from the apparatus.

45 Claims, 8 Drawing Sheets

FIG. 5
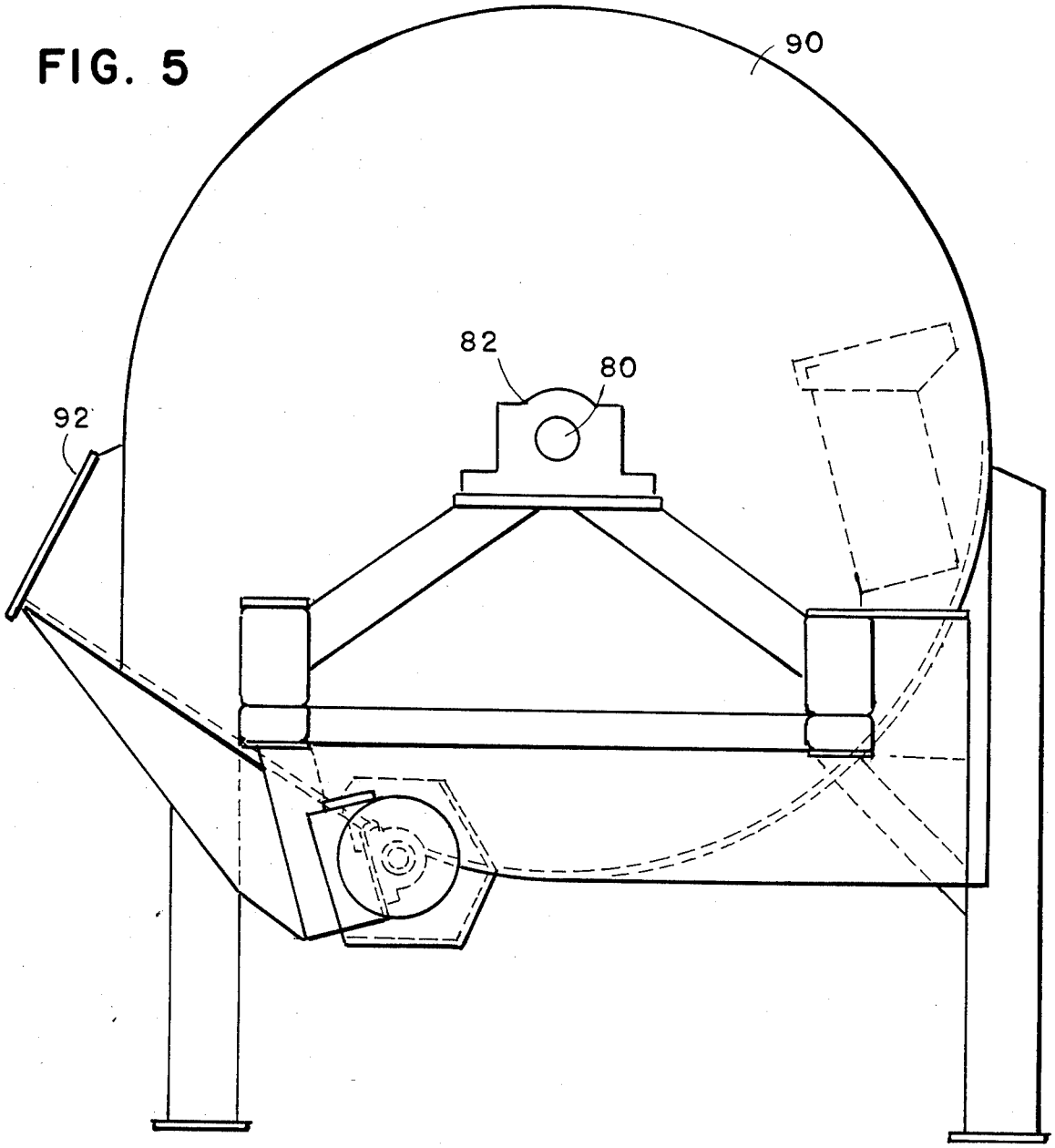
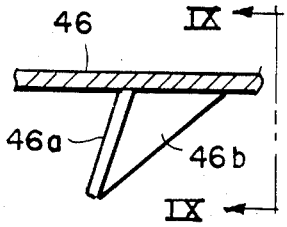
FIG. 8
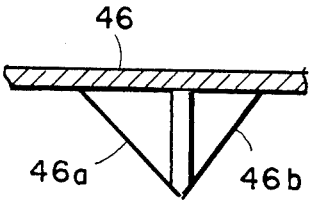
FIG. 9
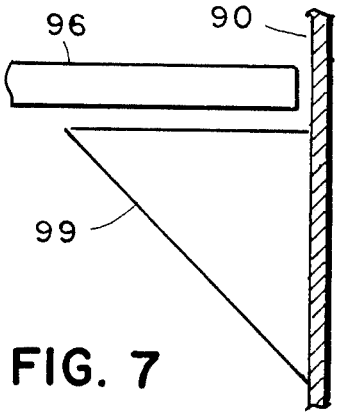
FIG. 7

FIG. 10
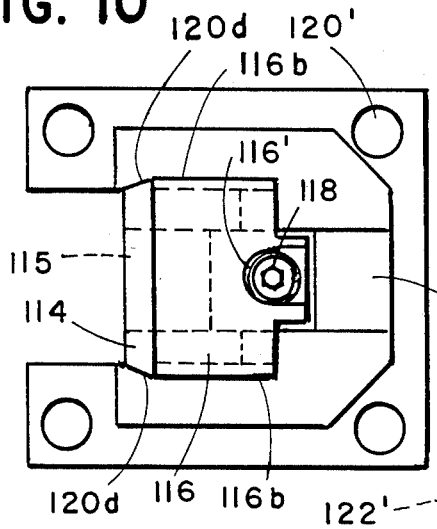
FIG. 11
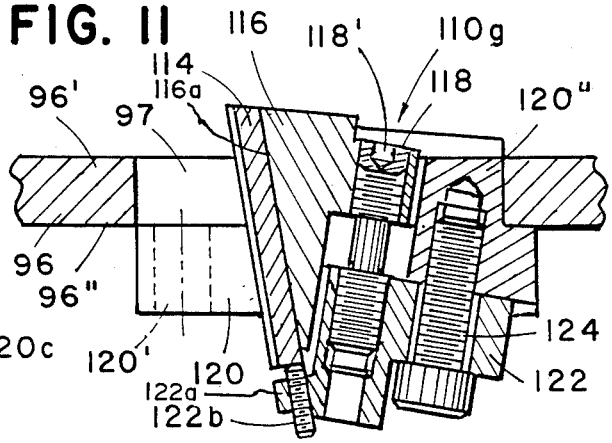
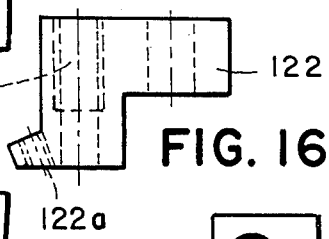
FIG. 16
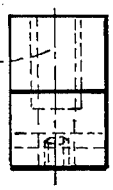
FIG. 17
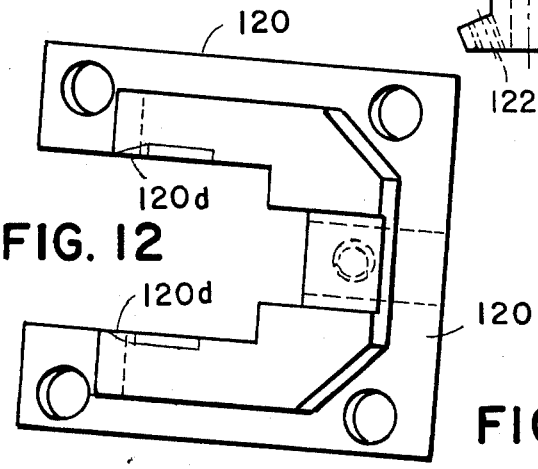
FIG. 12
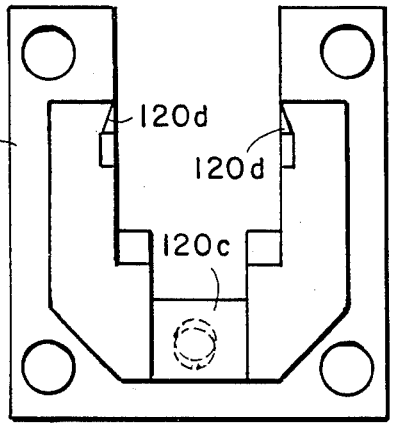
FIG. 13
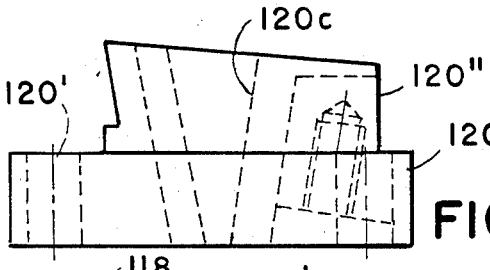
FIG. 15
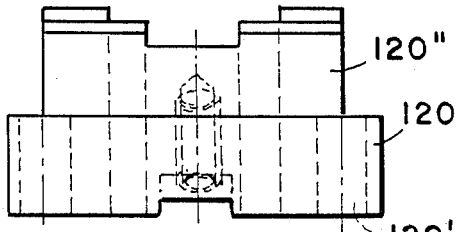
FIG. 14
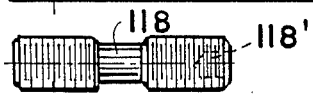
FIG. 21
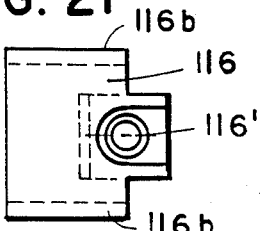
FIG. 20
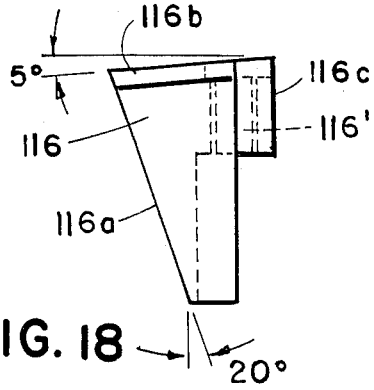
FIG. 18
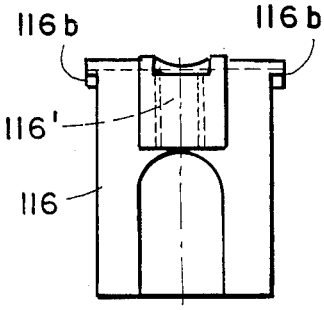
FIG. 19

FIG. 22
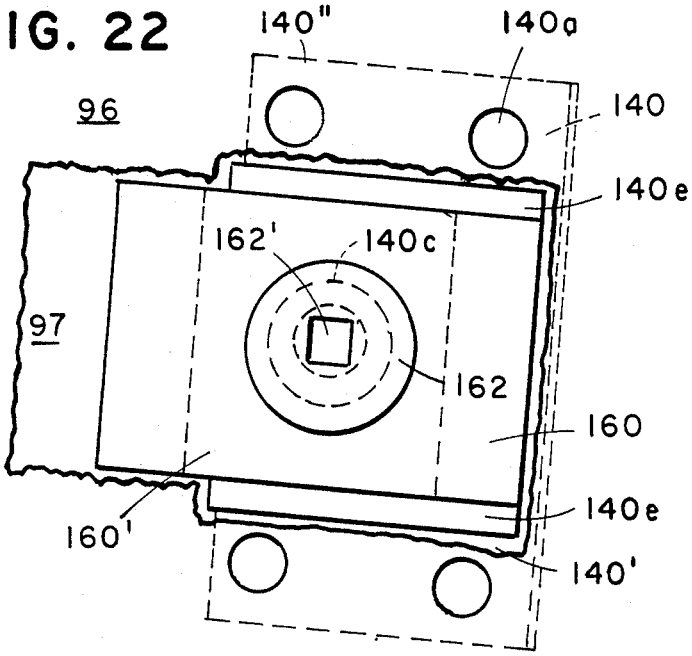
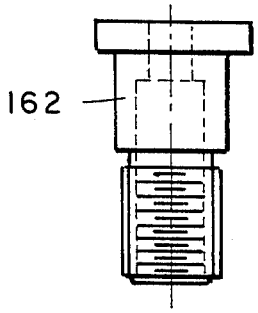
FIG. 24
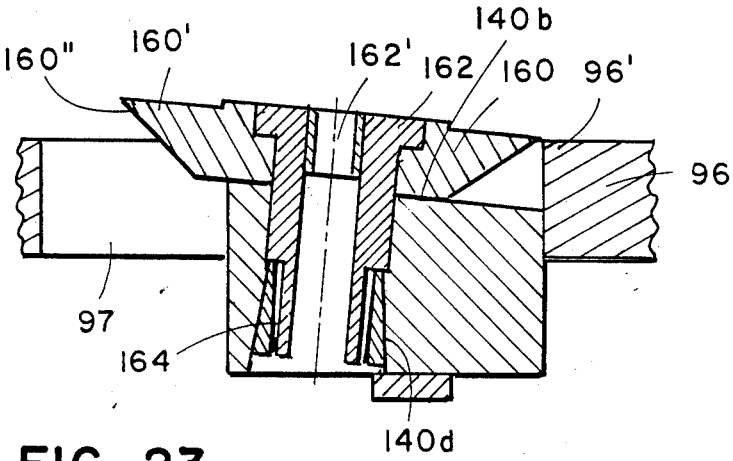
FIG. 23
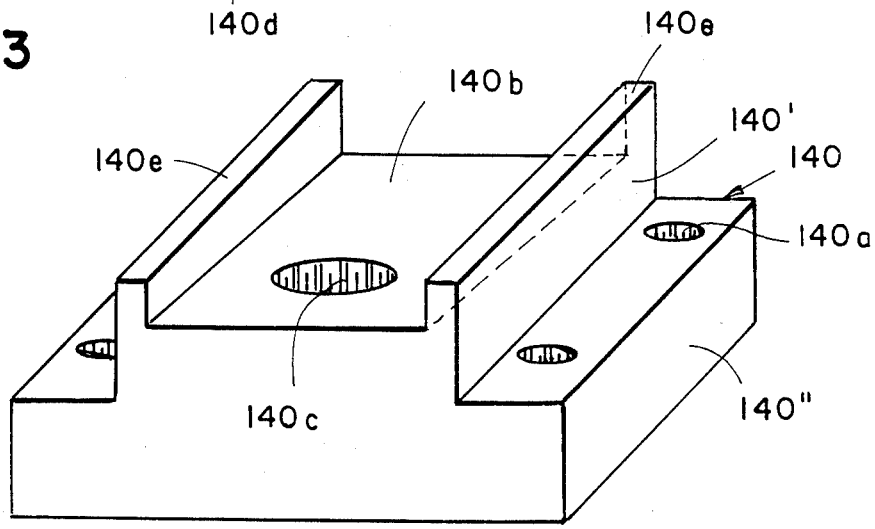
FIG. 25

STUMP DISINTEGRATOR

BACKGROUND OF THE INVENTION

This invention relates to a stump chipping disintegrator.

Clearing of wooded terrain for building construction or highway purposes has been greatly aided in recent years by the development of practical tree chipping equipment such as in U.S. Pat. Nos. 4,057,192, Re. 31,048 and 3,805,860 and brush chipping equipment as in U.S. Pat. No. 3,861,602. The trunks, limbs and tops of trees and brush can be chipped for fuel, paper manufacturing, chipboard fabrication and other uses. Alternatively, tree trunks can be separated for making lumber and plywood, while the branches and tops are chipped for fuel or the like.

Subsequently, the stumps are grubbed out of the ground and either piled up for burning or taken to landfills. Actually, both of these techniques for stump disposal are time consuming and expensive, and neither is environmentally satisfactory. Moreover, both are wasteful of natural resources. Specifically, piling and burning of stumps inevitably results in noxious smoke pollution. The stumps contain a great deal of moisture and dirt, and therefore are difficult to burn, so that burning usually involves adding considerable quantities of petroleum fuels, old tires and the like to encourage combustion. Even then, after many hours of effort and use of large equipment and attention, total combustion of the stumps is rarely accomplished.

Hauling stumps to landfills also requires extensive use of large machinery and hauling equipment. Further, more and more landfills are being closed in recent years due to environmental reasons. Operators of those remaining landfills often will not accept stumps for disposal. There is needed another effective way of dealing with these stumps. The present invention provides an effective way to chip stumps into chips useful as fuel, fabrication of paper or chipboard or otherwise. But stumps are extremely difficult to chip and destructive of machinery and often there are stones/rocks lodged in the roots, in addition to large quantities of dirt and the stump wood itself has roots extending in many directions, and differing grain patterns.

While the idea of chipping stumps on a drum chipper has been suggested previously in U.S.S.R. documents Kirov Forestry Ind. 17.10.77 SU-531940 and Kirov Timber Ind. 19.10.77 SU-536411, drum chippers are notorious for operational roughness, lack of effective feed control, formation of shredded product rather than uniform chips, and difficulty in replacement of blades, among others. As far as is known, no practical apparatus for disintegration of stumps has been developed heretofore, even though there has been a market for an effective stump disintegrator for some time. Information as to present efforts being conducted by others to chip stumps on presently available chippers indicates that equipment breakdown and/or blade destruction occurs in such a short time that known equipment is not at all practical.

Another wasted timber resource which presently exists is due to the inability to effectively harvest forest areas wherein large groups of trees have died out or have been downed as a result of forest fires, storm damage, or the like. For example, in many western states of the United States, thousands upon thousands of dead and/or downed trees, often several feet in diameter, are wasted because of no practical way to deal with them.

SUMMARY OF THE INVENTION

The present invention provides a practical stump disintegrator capable of enabling grubbed out stumps to be quickly and economically formed into chips, and even though the stumps contain tremendous amounts of dirt and even stones clinging thereto. This can be done on the site if desired, to enable the chips to be hauled away conveniently for subsequent use as fuel, raw material for chipboard fabrication and other uses. This avoids wasteful and polluting burning and/or burying of the stumps. Not only stumps, but also large sections, e.g. several feet in length, of giant downed trees can be chipped on site and, if desired, hauled away for efficient use elsewhere. Alternatively, the disintegrator can be located at a central location to which stumps and other tree sections are brought for processing.

The novel stump disintegrator has a trough forming a stump support, a chipping disc at one end of the trough with chipping blades projecting from the face at varying radial distances from the rotational axis of the disc, a driven ram plate at the other end of the trough for forcing stumps toward the disc, a plurality of diagonally oriented, pointed penetrating elements on the face of the ram plate, and a radially projecting stabilizer anvil adjacent the disc. The chipping disc has steel, wood slicing blades mounted in pockets in the radially central portion of the disc, and carbide, wood chopping blades mounted in pockets in the radially outer portion of the disc. The steel blades are at a small acute angle to the face of the disc. The carbide blades are at a large acute angle to the face of the disc, and are backed by wedges that extend substantially the width of the carbide blades and to the radially outer cutting end of the carbide blades.

Carbide elements have been known previously for use in machine tools, saw blades, and debarkers, but to the knowledge of the inventors, it has not been known to use carbide blades in a wood chipping machine combination as disclosed herein.

Stumps dropped into the support trough are disintegrated into chips which are discharged for use as desired. Much dirt and stones are vibrationally loosened from the stumps for removal at the bottom of the trough. Other dirt and stones are driven past the knives. The apparatus is preferably mobile, being mounted on a truck frame with wheels, for on site usage.

The carbide blades, and optimally the steel blades, are mounted on removable mounting bodies which have portions extending through pockets in the disc, the mounting bodies being removably attached to the disc for quick removal and resharpening or replacement of the blades.

The carbide blades are secured at a large acute angle to the disc by a locking wedge which secures dovetail edges of the blades in a dovetail slot on the holder, with the smaller width face located at the cutting edge.

These and other objects, advantages and features will become apparent upon studying the following detailed specification along with the drawings.

BRIEF DESCRIPTION OF THE DRAWINGS

FIG. 5 is a front elevational view of part of the drive mechanism for apparatus in FIG. 1;

FIG. 7 is a fragmentary plan view of a portion of the chipper disc and the anvil;

FIG. 8 is a fragmentary plan view of a portion of the ram plate and one of the stump penetrating projections;

FIG. 9 is a side elevational view of the projection in FIG. 8, taken in the direction of plane IX—IX of FIG. 8;

FIG. 10 is a front elevational view of the blade mounting assembly for carbide blades used in this invention;

FIG. 11 is a sectional view of the blade mounting assembly in FIG. 10, shown attached to the chipper disc;

FIG. 12 is a top, slightly perspective, plan view of the outer holder body of the assembly in FIG. 10;

FIG. 13 is a top plan view of the outer holder body in FIG. 12;

FIG. 14 is a side elevational view of the outer holder body in FIGS. 12 and 13;

FIG. 15 is an end elevational view of the outer holder body;

FIG. 16 is a side elevational view of the threaded inner holder nut;

FIG. 17 is an end elevational view of the nut member in FIG. 16;

FIG. 18 is a side elevational view of the blade clamping wedge of the assembly in FIG. 10;

FIG. 19 is a front elevational view of the blade clamping wedge;

FIG. 20 is an end view of the blade clamping wedge;

FIG. 21 is an elevational view of the differential screw in the assembly in FIG. 10;

FIG. 22 is a plan view of one optional embodiment of a steel blade holder assembly;

FIG. 23 is a sectional view of the steel blade holder assembly in FIG. 22 in a chipper disc;

FIG. 24 is an elevational view of a blade fastener from the assembly in FIG. 22;

FIG. 25 is a perspective view of the blade holder in the assembly of FIG. 22;

DESCRIPTION OF THE PREFERRED EMBODIMENTS

Stump Disintegrator Assembly

Figure 1:
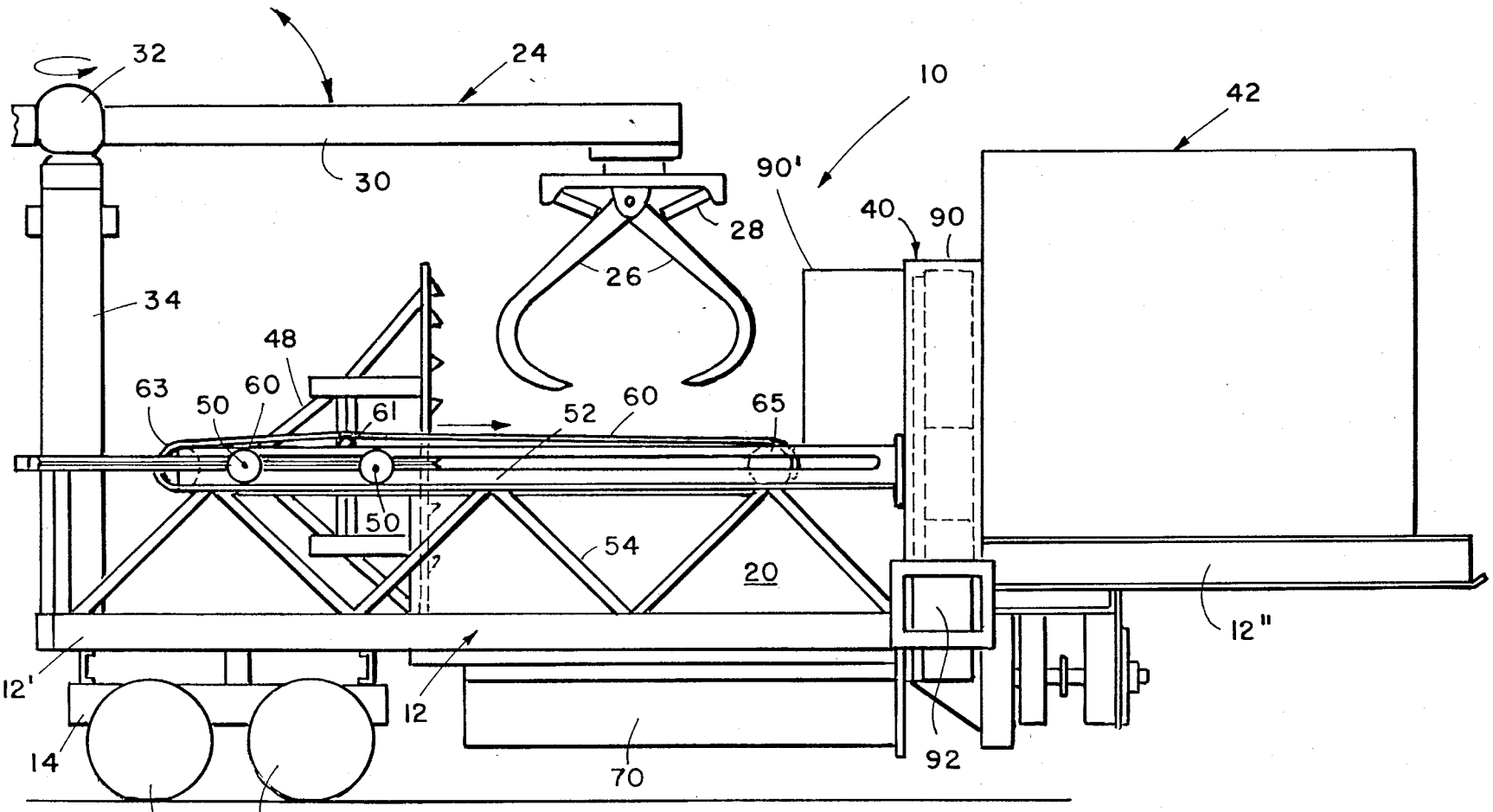
FIG. 1 is a side elevational view of the stump disintegrator of this invention shown in a mobile form.

Referring specifically to the drawings, the stump disintegrator assembly 10 there depicted is shown mounted on a frame 12 which comprises the bed of a truck trailer. This frame has a rear portion 12' beneath which a conventional suspension system 14 and wheels 16 are mounted. The frame also includes a front elevated portion 12'' which includes a conventional hitch (not shown) such as a fifth wheel king pin hitch for attachment to a fifth wheel or the like on a truck tractor (not shown).

Mounted on frame 12 is an elongated, front to rear, semicylindrical stump support trough 20 extending in the axial direction of the trailer. This trough has an open top for receiving stumps, large chunks of tree trunks or the like, placed there as by a crane 24 which can be mounted directly on the frame 12 of the disintegrator as depicted, or can be separate therefrom. This crane typically will include clamping arms 26 operated as by hydraulic cylinders 28 or the like, suspended on a cantilever beam 30 which preferably is capable of movement in three dimensions about a swivel 32 at the top of an upright support 34.

At the front portion of rear frame portion 12' is a chipper assembly 40 operated by a drive assembly 42 to be described.

At the rear of frame portion 12', forwardly of crane support 34, is a ram assembly 44. This ram assembly includes a ram plate 46 shown to be circular in configuration, the lower semicircular portion generally matching the semicylindrical configuration of trough 20 to more freely therealong at a clearance therefrom. This ram plate is shown mounted on a framework 48 which in turn is supported on roller wheels 50. These roller wheels move along a pair of respective parallel front to rear tracks 52 along opposite sides of the frame to enable the ram to be moved forwardly toward the chipping disc assembly 40 for chipping and away therefrom during return. This ram is powered by any suitable drive means such as a pair of powered recirculating chains on opposite sides of the assembly or a pair of elongated fluid cylinders. If chains 60 (FIG. 1) are used, each chain has its opposite ends attached to the ram assembly as at 61, and each extends around a pair of rear and front sprockets 63 and 65 adjacent the ends of tracks 52. One of the sprockets, e.g., 63, is powered as by an hydraulic motor (not shown) for forward and reverse movement of the ram. Alternative drive mechanisms could be employed.

Figure 6:
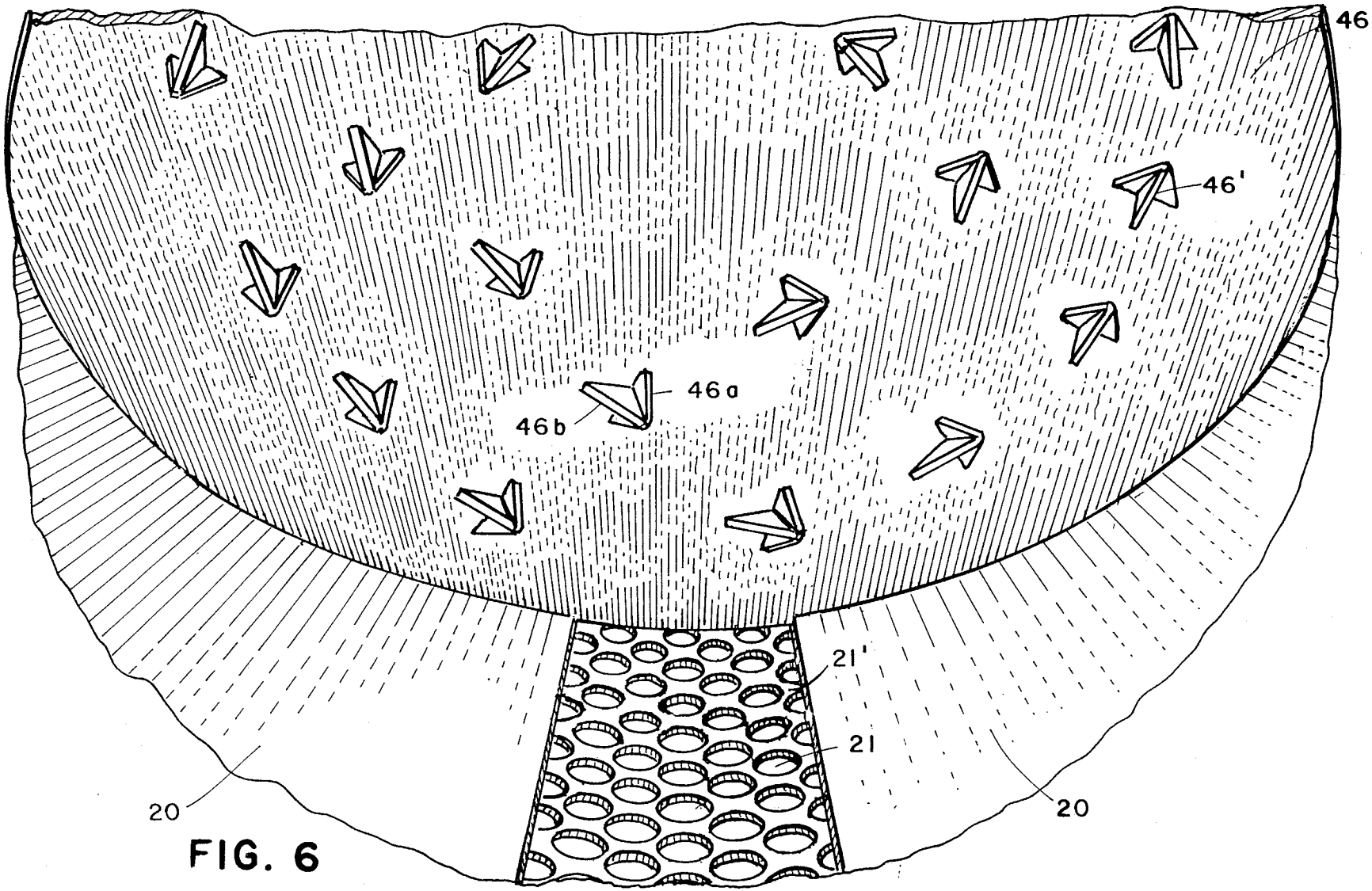
FIG. 6 is a fragmentary perspective view of a portion of the trough and ram plate of this apparatus.

The roller tracks 52 are mounted on diagonal bracing supports 54, the lower ends of which are mounted on frame 12. The inside forward face of ram plate 46 includes a plurality of stump penetrating, pointed projections 46' (FIG. 6) which project axially from the face of the ram plate. Each of these projections is shown to include two triangular plates at 90 degrees to each other, i.e., plates **46*a* and 46*b* in mutually reinforcing manner. The outer apices form a sharp protrusion for penetrating stumps, etc. which are being forcefully advanced by the ram during the operation. These are located at differing radial locations over the face of the ram. They project not only axially, but also circumferentially diagonally in the rotary direction opposite to which the disc rotates during operation, to optimize the restraining and stabilizing action on the stumps being chipped. Thus, referring to FIG. 6, plates 46*a*** slope in a common angular direction in a counterclockwise direction as depicted to counteract rotational force by a clockwise rotating drive.

The bottom of trough 20 (FIG. 6) has a perforate structure. Preferably the arcuate, axially elongated plate 20' contains a large number of openings 21, to allow dirt, small stones and other debris to fall out of the trough. This dirt, etc. is shaken loose from the stumps during the disintegration process conducted by the apparatus. Beneath this perforate panel is preferably an elongated auger housing 70 (FIG. 1) containing a helical auger or any type of conveyor therein (not shown) for conveying this material into a suitable receptacle (not shown).

The drive assembly 42 (shown in FIG. 1 in a housing) may include a large internal combustion engine of sufficient capacity to operate chipper assembly 40, auger 70, the hydraulic pump for fluid cylinders 60 on the ram (or other equivalent drive) and optionally the crane 24.

The drive connection from the power supply engine to chipper assembly 40 may be by means of a suitable gear box (not shown), or pulleys and belts, or hydraulic motors or the equivalent, the purpose being to rotate the chipper disc assembly on its central shaft 80 (FIGS. 4 and 5) supported on suitable pillow block bearings 82.

Chipper Assembly

Chipper assembly 40 includes an annular housing 90 which is axially open toward trough 20. It contains the chipper mechanism and includes a discharge chute 92 (FIGS. 1 and 5) which extends tangentially for discharge of chips into a connecting chute (not shown), or into a semi trailer or other receptacle, or simply onto the ground as desired. The chipper mechanism includes a circular chipper disc 96 having a plurality of chipper blades mounted thereon, and a circular back plate 98 spaced behind and parallel to the chipper disc. Plate 98 is secured to the chipper disc by a plurality of radially oriented fan blades or paddles 100 (here four in number) spaced at intervals around the structure for throwing and guiding the chips to chute 92 as well as securing these two plate type discs 96 and 98 together. The assembly is mounted on shaft 80 by hub 98' by disc 98 being mounted on a tapered spindle 102 and retained on the spindle by a lock plate 104 on the reverse tapered portion of hub 102 and secured to disc 98 by a plurality of tie bolts 106. This type of structure for mounting a chipper disc is conventional. The annular housing 90 includes upper semi-cylindrical cowl 90' (FIGS. 2 and 4) which extends axially beyond disc 96 toward ram plate 46. This cowl and the underlying semi-cylindrical front portion of trough 20 adjacent the disc thus comprise an infeed spout to and around the chipping disc. This infeed spout thus has a diameter substantially equal to the diameter of the disc (See FIGS. 1, 2 and 4).

Figure 3:
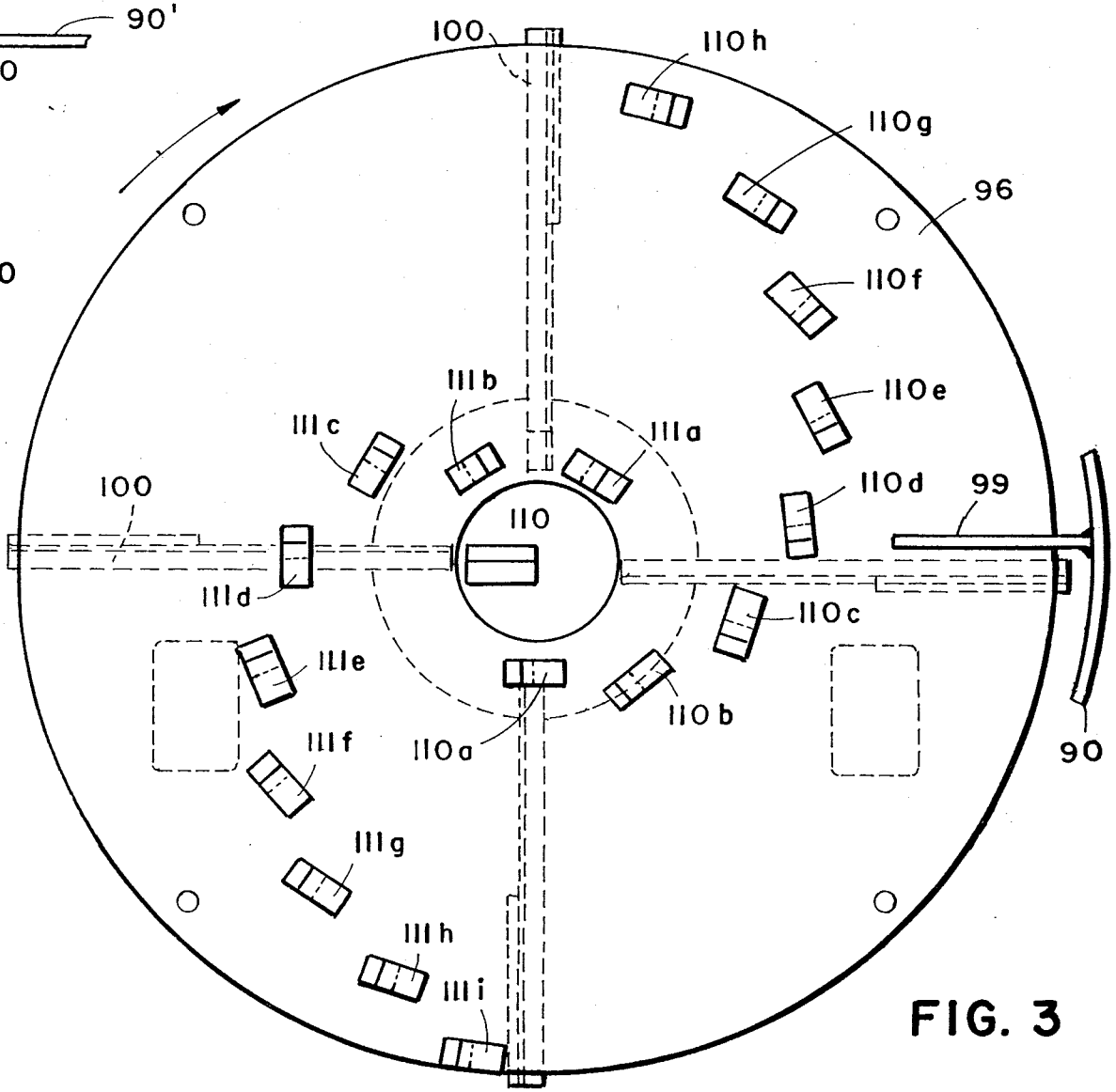
FIG. 3 is a front elevational view of the chipping disc assembly of this invention.
Figure 4:
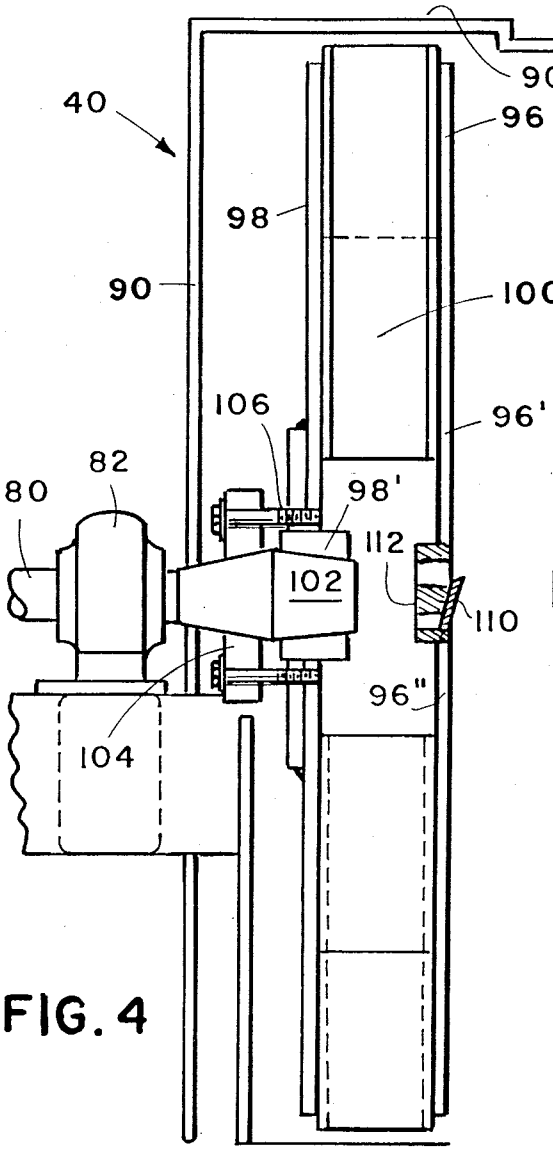
FIG. 4 is a side elevational view of the chipping disc assembly in FIG. 3.

The chipper blades are mounted at various radial locations relative to the central rotational axis of the chipper disc. These are preferably arranged in a spiral pattern, shown in FIG. 3 to be in two spiral series of blades to cover all radial portions of the disc. Certain of these blades are toward the central region of the chipper disc while others are toward the outer region of the disc. The innermost blade assembly 110 is immediately alongside the axial center of the disc and is preferably longer than the others. It and blade assemblies **110*a*, 110*b*, and 110*c* in one set are all within a radius less than about one-half the total radius of the disc, while blade assemblies 110*d*, 110*e*, 110*f*, 110*g* and 110*h* are in the outer region of the disc. The blades in the second series are radially offset relative to the blades in the first series so as to match the spaces therebetween, i.e., so that every radial portion of the disc will have a cutting blade somewhere around its circumference. The second series of blade assemblies likewise has blade assemblies 111*a*, 111*b*, and 111*c* within the central region, while blade assemblies 111*d*, 111*e*, 111*f*, 111*g*, 111*h* and 111*i* are in the outer region of the disc. The blades in the central region are steel blades mounted in a particular fashion described hereinafter. The blades in the outer region are carbide blades mounted differently, in the manner explained hereinafter. The steel blades are preferably within the inner about 30–50% of the radial extent of the disc, while the carbide blades are within the outer about 70–50% of the radial extent. Most preferred is the ratio of about 40–60% respectively. Thus on a 96 inch diameter disc, the inner 40 inch diametrical portion will have steel blades and the outer 56 inch portion will have carbide blades. Each of the blades, whether steel or carbide, is mounted in a pocket or opening which extends from the front face 96' of the chipper disc, i.e., the face from which the blade projects, to the rear face 96'' (FIG. 4). The carbide blades each are on a special blade holder to which the blade is removably attached and which itself is removable from the disc (FIGS. 10–20**) as explained hereinafter.

The steel blades, e.g., the blade of assembly 110 (FIG. 4), may be conventionally bolted directly to a fixed holder 112 which is fixedly attached as by welding to chipper disc 96 at the disc pocket. Alternatively, the steel blades can be mounted to a removable holder in the fashion set forth in FIGS. 22–25 and explained hereinafter, or can alternatively be mounted in the removable holder set forth in FIGS. 26–28 also explained hereinafter.

A stump stabilizing anvil 99 (FIGS. 3 and 7) projects axially and also radially inwardly from the side of chipper housing 90, adjacent disc 96 and spaced therefrom. This anvil is shown in the form of a tapered plate with decreasing width toward the central portion of the disc. This generally triangular plate is welded at its outer edge to housing 20, and has its apex at its radially inner end. It may extend approximately one-third of the radial extent of the disc, although this can vary.

Carbide Blade Assemblies

Referring now to FIGS. 10–20, a representative one of the carbide blade assemblies, e.g., **110*h*, is there depicted and shown in FIG. 11 to be mounted in one of the pockets 97 in chipper disc 96. The carbide blade 114 has a dovetail fit with its holder. More specifically, the two tapered lateral side edge portions of the blade fit within a receiving slot formed into the inside faces of the opposite legs of a U-shaped outer holder body 120, the opposite slot portions being tapered to match the tapered edges of blade 114 (FIG. 10). Outer holder body 120 has a plurality of fastener receiving orifices 120' at its four corners to enable it to be mounted by bolt fasteners (not shown) to threaded orifices in the rear face 96'' of chipper disc 96 at the periphery of pocket 97. Holder member 120 has a central portion 120'' (FIGS. 11 and 14) which fits down into the pocket in the chipper disc. Secured by threaded fastener bolt 124 to the inside face of holder member 120 is an inner holder nut member 122. This nut member 122 includes a threaded socket 122' (FIG. 16). Engaging the back face of blade 114 is tapered front face 116*a* of a wedge member 116 having a threaded socket 116' (FIG. 18). A differential threaded fastener 118 (FIG. 11 and FIG. 21) has left hand threads on one end and a right hand threads on the opposite end to threadably engage sockets 116' and 122'. Rotation of the fastener will pull wedge 116 down toward holder body 122 and thereby bind blade 114 into the slot 120*d* in 120. The rear face 116*c* of wedge 116 engages wedge face 120*c*** of the body.

As noted from FIG. 4, and a description of FIGS. 22–28 hereinafter, it is typical to use steel blades for chipping wood in brush chipping, tree chipping and wood slab chipping equipment. Such steel blades are mounted with the outer face thereof at a very small acute angle, usually around five degrees, relative to the chipper disc face. Further, the front cutting face of the steel blade is at a small acute angle, preferably around 36 degrees or less, relative to the face of the chipper disc. The angle of the outer face to the cutting face is typically about 31 degrees. Efforts to increase the angle of a steel blade front cutting face relative to the face of the chipper disc to a large acute angle are generally unsuccessful since the cutting edge will not cut as effectively, and quickly dulls, dents and otherwise deteriorates to render the blade useless. The steel blade serves to slice wood and also aid in pulling the stock into the blades. In sharp contrast to this, applicants have found that by the use of the carbide blade mounting structure set forth herein, with the carbide blades mounted so that their cutting face is at a very large acute angle to the chipper disc face, excellent results are achieved in disintegrating stumps and the like, even containing dirt, stones and other debris. The special combination of steel blades and carbide blades is highly effective. Mounting the carbide blades at a small acute angle comparable to that normally required with steel blades proved to result in rapid deterioration and breakage of the blades to quickly render them quite useless. The angle of the cutting face 114' (FIG. 11) of the carbide blades relative to front face 96' of the chipping disc should be very large. The range of about 70 to 85 degrees produces best results, with 80 degrees being optimum. The angle should be above about 37 degrees and up to 90 degrees. In the range approaching 37–45 degrees, the carbide blades tend to disintegrate fairly rapidly.

The outer narrow face of the carbide blade has a small clearance angle of about 5 degrees or so relative to a plane normal to the disc front face. The angle between the outside face and the cutting front face of the blade is thus preferably about 75 degrees.

Wedge 116 should extend substantially the entire width of the carbide blade, particularly at the engagement portion of the blade which projects beyond face 96' of chipper disc 96 to act upon the stump. Therefore, wedge 116 is provided with laterally extending shoulders **116*b* at its radially outer end (FIGS. 18 and 19), which shoulders extend to the side edges of the carbide blades. The wedge also extends radially outwardly substantially to the outer edge of blade 114. These shoulders 116*b* extend radially inwardly approximately ¼ inch or so. When the moving blade engages the wood of the stump, or stones or the like, the blade is put in compression against the back-up wedge to cause a chopping type action on the material. The wedge applies a counter acting compressive force. The fact that the front cutting face of the carbide blade is narrower than the rear backup face (FIG. 10**) adds additional support to the blade.

An opening **122*a* in nut 122 beneath blade 114 (FIG. 11) receives an allen head set screw 122*b* for forming a dead stop to adjust the radial position of blade 114 prior to tightening of fastener 118. Fastener 118 is tightened by inserting a tool, e.g., Allen wrench, into polygonal recess 118'**.

Ahead of blade 114, and between the outer ends of the legs of wedge body 120, is an opening 115 (FIG. 10) which extends into pocket 97 to allow chips removed by blade 114 to pass through the blade assembly and the pocket and out the rear of the chipping disc.

Removal or adjustment of carbide blades can be readily achieved from the front face of the disc by loosening the wedge. Alternatively the entire blade and holder mechanism can be removed from the rear face of the disc.

First Alternative Steel Blade Assembly

Referring now to FIGS. 22–25 which set forth one alternative embodiment of the steel blade mounting mechanism, holder 140 includes a central portion 140' which extends down into a pocket 97 in chipper disc 96, with laterally extending shoulders 140" (FIG. 24) overlapping the edges of the pocket so that suitable fasteners (not shown) can be extended through the openings **140*a* for threaded attachment to back face 96" of chipper disc 96. The outer face 140*b* of holder 140 is sloped to be at a very small acute angle relative to the front face of the chipper disc, preferably about five degrees. Extending through the holder and terminating at sloped face 140*b* is an opening 140*c* which has an inner tapered portion 140*d*. Thus, by placing steel blade 160 (FIG. 22) on sloped face 140*b*, and extending a hollow threaded fastener 162 through the opening in the center of blade 160 and through opening 146*c*, the lower threaded portion of the fastener can be threadably engaged with an axially tapered threaded, hollow annular bushing 164 (FIG. 22) which binds into portion 140*d* to lock the blade in position. Preferably a pair of side walls 140*e* is also provided to assist in stabilizing blade 160 in place. The outer face 160' of the blade has a clearance angle of a small acute angle, e.g., about five degrees as noted above, relative to the front face 96' of chipper disc 96. The front cutting face 160" is normally at an angle to face 160' of about 31 degrees, so as to be at a cutting angle relative to face 96' of a small acute angle of approximately 36 degrees or less. Steel blade 160** is shown to be rectangular in configuration, and preferably has a cutting edge and front cutting face at both the front and back opposite edges so as to be rotatable when one is dull.

Fastener 162 has a through passage 162' extending axially through it, with the upper portion of the passage being polygonal in configuration (see FIG. 21) to enable a suitable wrench to be inserted for loosening it. The through passage enables wood which becomes jammed in the polygonal portion to be driven out with a suitable punch for clearing the fastener of such debris. The front cutting edge and front cutting face of the steel blade are spaced from the adjacent wall of pocket 97 so as to leave a space through which the wood chips can pass from the front face 96' through the chipper disc, out the rear face for passage out of the equipment.

The fasteners that secure holder 140 to back face 96" of chipper disc 96 are accessible from the rear of the disc where jamming of wood into the fasteners is not a problem. Therefore, instead of the blade being removed from the front face of the disc, the entire blade and its holder can be removed from the rear face to enable quick replacement of the blade and holder.

Second Alternative Steel Blade Assembly

Figure 26:
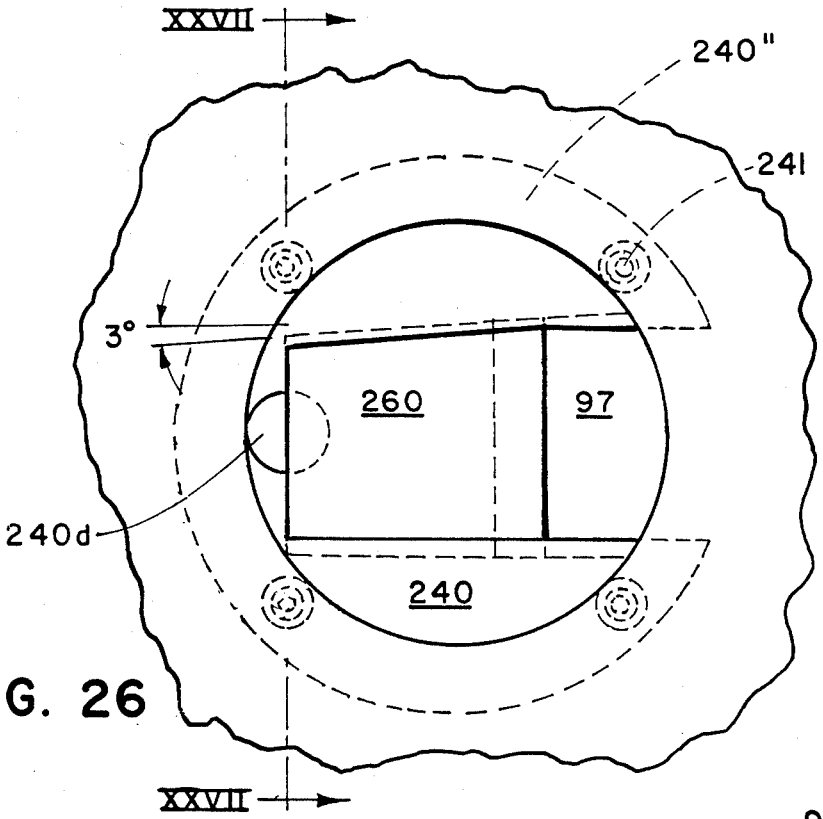
FIG. 26 is a plan view of a second optional embodiment of steel blade mounting assembly.
Figure 27:
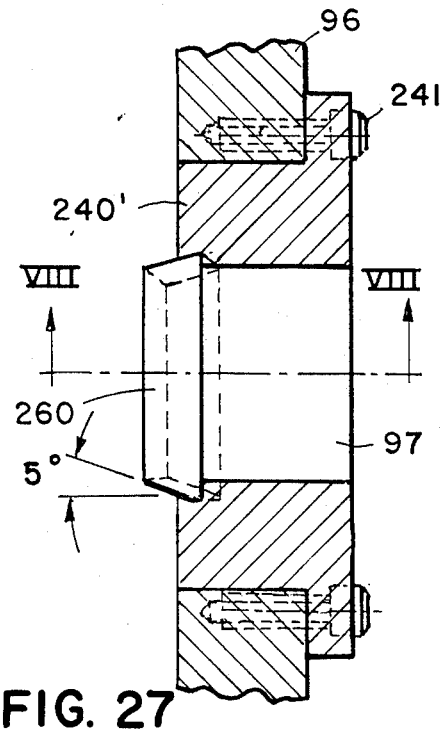
FIG. 27 is a sectional view taken on plane XXVII—XXVII of FIGS. 26 and 28.
Figure 28:
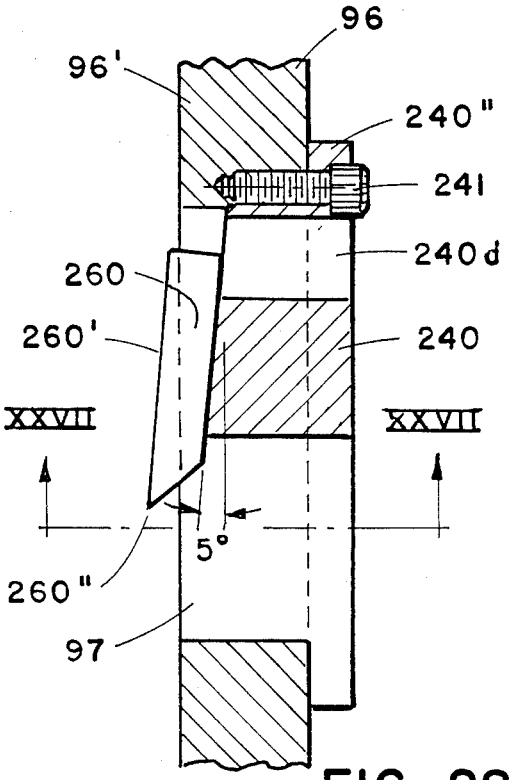
FIG. 28 is a sectional view taken on plane XXVIII—XXVIII of FIG. 27.

The second alternative embodiment steel blade mounting assembly is depicted in FIGS. 26–28. Here again, holder 240 is mounted in pocket 97 of chipper disc 96 such that steel blade 260 extends beyond front face 96' of the disc. The front cutting face 260" again is at an angle relative to face 96' of approximately 36 degrees or less. Outer face 260' has a clearance angle of about five degrees or so, i.e., a very small acute angle relative to face 96' Thus, face 260' is at an angle of approximately 31 degrees to front cutting face 260''. Holder 240 is secured to the rear face of disc 96 by shoulders 240'' having openings therethrough through which fasteners 241 extend into threaded engagement with chipper disc 96. The central portions 240' of holder 240, extend into pocket 97. This structure is shown to be circular in configuration (FIG. 25) rather than rectangular, although this configuration may vary as desired. In this embodiment, blade 260 has dovetailed interfitted edges with a dovetailed slot of holder 240. It also has at least one edge tapered from end to end, e.g., about three degrees (see FIG. 26), the small angle serving to effect a wedging fit upon insertion of the blade into the holder. Action of the blade against the material being chipped will tend to drive the blade further into this wedging relationship for securing it. Removal of the blade can be done simply by inserting a drift into opening **240*d* against the back edge of blade 260 to drive it forwardly out of the groove for replacement of the blade. Instead of replacing the blade on the disc, it can be replaced by removal of the entire holder 240 with removal of fasteners 241** from the rear face of the disc.

Operation

Figure 2:
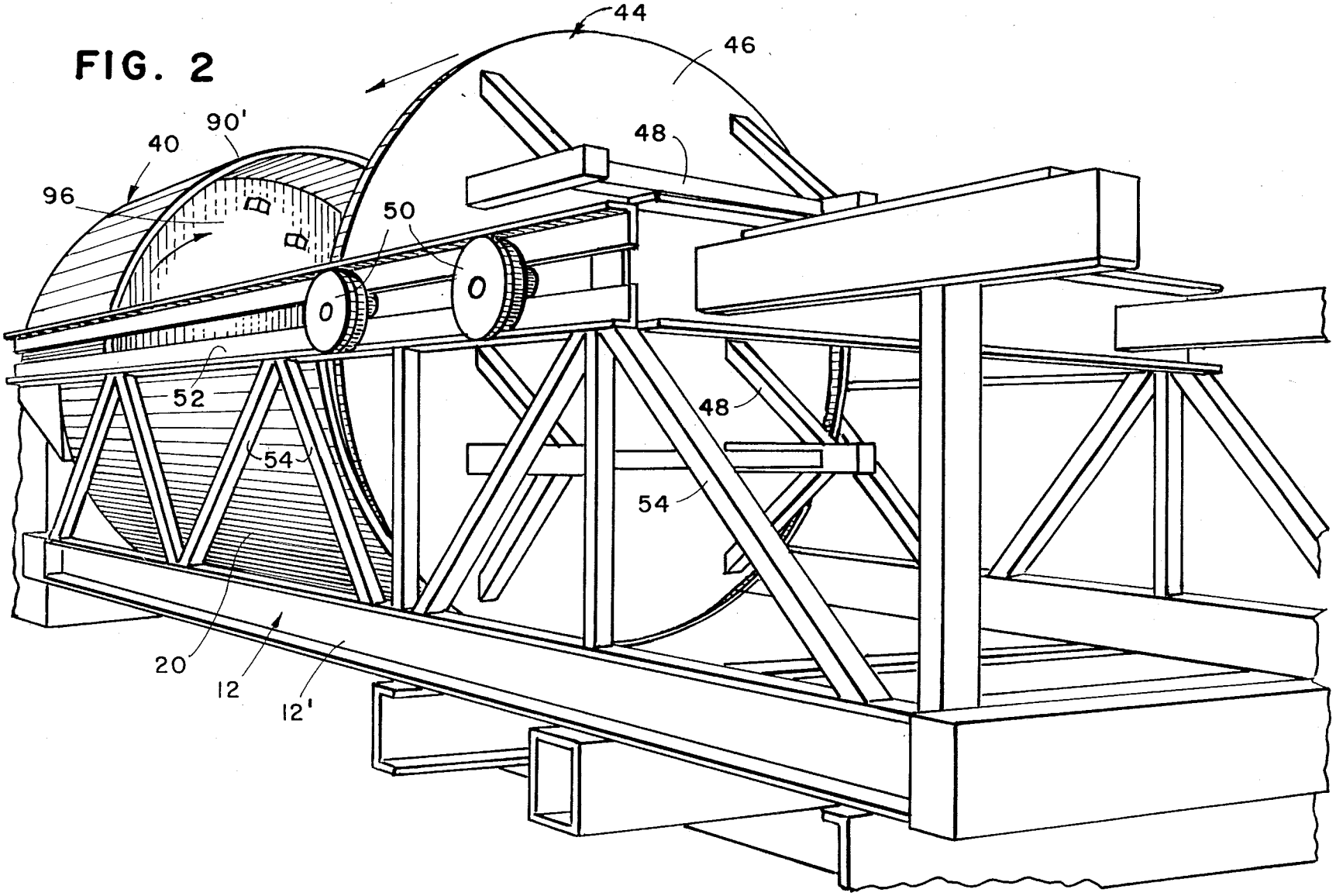
FIG. 2 is a rear perspective view of the apparatus in FIG. 1.

In operation of the novel apparatus, it is preferably in the mobile form illustrated in FIG. 1, to be drawn by a suitable truck tractor to a location for chipping of stumps and the like. Alternatively, it can be placed at a central location to which stumps, large log sections or the like are brought for chipping. The stumps are placed by crane 24 or the equivalent in support trough 20 when ram 44 is in the retracted rearward position, and power is supplied to the chipping disc to rotate it. The ram is advanced forwardly to push the stumps to the chipping disc. Frequently, the central core of the stump will be near the center region of the disc. The steel chipping blades at the inner part of the disc, are at the small acute angle of approximately 36 degrees, and tend to pull the stump into the disc as they slice chips of wood therefrom. The ram assists in feeding material. The heavy radiating root sections, which tend to contain more dirt, rocks and other debris, radiate out toward the outer region of the disc. The carbide blades located in this region hammer or chop chunks of wood, rock and debris from the material as the disc rotates. These chips and chunks from both types of blades pass through pockets 97 to move through disc 96 into the space between it and backup plate 98 where fan blades 100 channel the chips and propel them through discharge chute 92.

The novel apparatus has demonstrated its effectiveness under brutal operating conditions for disintegrating large stumps and the like into chips which can be used for fuel or otherwise. The equipment is capable of operating for considerable periods of time without blade replacement. The specially mounted carbide blades performed surprisingly well.

It is conceivable that those in the art may modify certain features in the illustrated preferred embodiment, while employing the inventive concepts presented herein. Thus, to suit a particular type of installation, such variations might be made to accommodate particular size and type of material being treated. It is also conceivable that the individual carbide blade and/or steel blade mounting assemblies may be employed on chipping equipment other than stump disintegrators. Therefore, it is intended that the inventions set forth herein are to be limited only by the scope of the appended claims and the reasonably equivalent structures to those defined therein, rather than to the illustrated preferred embodiments.

The embodiments of the invention in which an exclusive property or privilege is claimed are defined as follows:

1. A stump disintegrator comprising:

a stump receiving trough having first and second ends;

a rotatably mounted chipper disc at said first end of said trough;

drive means operably connected to said chipper disc to rotate said disc about its axis;

a plurality of chipping blades at the face of said chipper disc at varying radial locations thereof for chipping portions of stumps forcibly fed to said disc;

stump stabilizer anvil means projecting radially inwardly adjacent the outer radial portion of said disc for stabilizing the stumps against the force of the rotating disc;

a power ram at the second end of said trough, movable toward said disc, said ram having stump penetrating means projecting generally axially toward said first end of said trough and located radially offset of the rotation axis of said disc, for penetrating the stumps, whereby stumps placed in said trough can be axially force fed to said chipping disc by said ram while the stumps are stabilized against rotation by both said stump stabilizing anvil means and said stump penetrating means.

2. A stump disintegrator comprising:

a stump receiving trough having first and second ends;

a rotatably mounted chipper disc at said first end of said trough;

drive means operably connected to said chipper disc to rotate said disc about its axis;

a plurality of chipping blades at the face of said disc at varying radial locations thereof for chipping portions of stumps forcibly fed to said disc;

stump stabilizer anvil means projecting radially inwardly adjacent said disc for stabilizing the stumps;

a power ram at the second end of said trough, movable toward said disc, to force stumps in said trough to said chipping disc.

3. The stump disintegrator in claim 1 wherein said stump stabilizer anvil means is a radial-axial projection adjacent said disc.

4. The stump disintegrator in claim 3 wherein said stump penetrating means comprise pointed projections on said ram.

5. The stump disintegrator in claim 3 wherein said radial axial projection is a tapered plate with decreasing width from the outer edge portion of the disc toward the central portion of the disc.

6. The stump disintegrator in claim 3 wherein said radial axial projection is a triangular element projecting a fraction of the radius of said disc and decreasing in width from the outer disc edge.

7. The stump disintegrator in claim 1 wherein said stump penetrating means comprise a plurality of pointed projections which extend diagonally from said ram as well as generally axially toward said first end of said trough, to project generally opposite the direction of the disc rotation.

8. A stump disintegrator comprising:

a stump receiving trough having first and second ends;

a rotatably mounted chipper disc at said first end of said trough;

power drive means operably connected to said chipper disc to rotate said disc in one direction about its axis;

a plurality of chipping blades at the face of said disc at varying radical locations therearound and extending beyond said disc face for chipping portions of stumps forcibly fed to said disc;

a power ram at the second end of said trough, movable toward said disc, said ram having stump penetrating means projecting generally axially toward said first end of said trough and located radially offset of the rotation axis of said disc at varying radial distances from said axis, for penetrating the stumps, said penetrating means being pointed projections which extend diagonally in a rearward direction relative to the direction of disc rotation, whereby stumps placed in said trough are axially force fed to said chipping disc by said ram while said projections tend to stabilize the stumps against rotation.

9. The stump disintegrator in claim 8 wherein said blades have a cutting edge projecting beyond the face of said disc at a forward angle relative to the direction of disc rotation, and wherein said stump penetrating means comprise a plurality of pointed projections projecting diagonally from the face of said ram plate at a rearward angle relative to the direction of disc rotation.

10. The stump disintegrator in claim 8 including dirt removal opening means at the bottom of said trough for discharge of dirt shaken from the stumps.

11. A stump disintegrator comprising:

a stump receiving trough having first and second ends;

a rotatably mounted chipper disc at said first end of said trough;

drive means operably connected to said chipper disc to rotate said disc about its axis;

a power ram at the second end of said trough for forcing stumps toward said chipper disc;

a plurality of chipping blades projecting from the face of said chipper disc, at varying radial locations thereon for chipping portions of stumps fed to said disc;

said chipping blades including radially inner blades toward the center region of said disc, and radially outer blades toward the outer region of said disc;

said blades toward the center region of said disc being steel blades and said blades toward the outer region of the disc being carbide blades.

12. The stump disintegrator in claim 11 wherein said steel blades are at a small acute angle relative to the face of said disc.

13. The stump disintegrator in claim 12 wherein said carbide blades are at a large acute angle relative to the face of said disc.

14. The stump disintegrator in claim 11 wherein the front cutting face of said steel blades is at a small acute angle relative to the face of said disc, and the front cutting face of said carbide blades is at a large acute angle relative to the face of said disc.

15. The stump disintegrator in claim 14 wherein the angle of said front cutting face of said carbide blades to said disc face is in the range of 37 to 90 degrees.

16. The stump disintegrator in claim 14 wherein the angle of said front cutting face of said carbide blades to said disc face is in the range of about 70 to 85 degrees.

17. The stump disintegrator in claim 14 wherein the angle is about 80 degrees.

18. The stump disintegrator in claim 15 wherein the angle of said leading face of said steel blades to said disc face is no greater than about 36 degrees.

19. The stump disintegrator in claim 14 including backup means behind said carbide blade extending substantially the width of said carbide blade and out to substantially the radially outer edge of said carbide blade.

20. The stump disintegrator in claim 19 wherein said backup means comprises a wedge that locks said carbide blade in position in compression relative to the material being acted upon during chipping.

21. The stump disintegrator in claim 20 wherein the radially outer end of said carbide blade has a wider rear edge and a narrower front wood engaging edge.

22. A wood chipper disc assembly comprising:

a rotational disc having front and rear faces and at least one blade receiving pocket therein;

holder means in said pocket for mounting a wood chipping blade at a large acute angle of 37 to 90 degrees to said front face;

a carbide blade mounted by said holder means in said pocket at a large acute angle of 37 to 90 degrees, to project beyond said front face at said large acute angle;

back-up means behind said carbide blade extending substantially the width of said carbide blade and out substantially to the radially outer edge of said carbide blade;

said back-up means comprising a wedge that locks said carbide blade in position in compression back-up support to wood being engaged.

23. The wood chipper disc assembly in claim 22 wherein the radially outer end of said carbide blade has a wider rear edge and a narrower front, wood engaging edge, said radially outer end of said blade being trapezoidal in configuration.

24. The wood chipper disc assembly in claim 22 including a threaded fastener removably connecting said wedge to said holder means; and fastener mean for mounting said holder means to said disc.

25. The wood chipper disc assembly in claim 24 wherein said threaded fastener is differential threaded on its opposite ends.

26. The wood chipper disc assembly in claim 22 wherein said large acute angle is within the range of 70 to 85 degrees.

27. The wood chipper disc assembly in claim 22 wherein said large acute angle is about 80 degrees, and said blade has an outer face at a small clearance angle.

28. A wood chipper disc assembly comprising:

a rotational disc having a front and rear face and at least one pocket therein;

a blade holder mounted in said pocket, including a blade receiving slot therein;

a carbide blade in said slot having a cutting face portion projecting beyond said disc front face;

a wedge back-up element behind said blade in said holder to retain said blade in said slot;

fastener means for securing said wedge element in said holder;

means for securing said blade holder in said pocket so that said carbide blade is at a large acute angle in the range of 70 to 85 degrees to said front face;

said back-up wedge element behind said carbide blade extending substantially the width of said carbide blade behind said cutting face portion and out substantially to the radially outer edge of said carbide blade;

the radially outer end of said carbide blade having a wider rear edge and a narrower front cutting edge whereby said radially outer end of said blade is trapezoidal in configruation.

29. A disintegrator for stumps or the like comprising:

a rotational disc having a front face and pockets therein;

blade holders in said pockets;

a plurality of carbide blades mounted in said blade holders at a large acute angle of 37 to 90 degrees to said front face, and projecting from said front face;

support means adjacent said disc for supporting stumps or the like to be disintegrated by said carbide blades;

anvil means adjacent said disc front face for stabilizing stumps or the like being chipped by said blades; and means for advancing stumps or the like at said support means toward said disc and said carbide blades for chopping chunks for the stumps or the like.

30. The stump disintegrator in claim 29 wherein said blade holder includes a blade receiving slot, and a wedge element behind said carbide blade for securing said blade in said slot;

said wedge element extending substantially across the width of said carbide blade at the outer end of said blade, and radially out to substantially the radially outer end of the blade, in a manner placing said carbide blade in compression; and the radially outer end of said carbide blade having a wider rear edge and a narrower front cutting face edge.

31. The stump disintegrator in claim 30 wherein said slot and said blade have corresponding dovetail edges to interfit.

32. A wood chipper disc and knife assembly comprising:

a rotational disc having front and rear faces and having pockets therein;

blade mounting holders in said pockets and removably secured to said disc;

said holders each having a dovetail slot;

dovetail chipper blades mounted in said slots by said holders to protrude from the disc front face for chipping, whereby removal of said holders and said chipper blades from said disc can occur as a unit.

33. The chipper disc and knife assembly in claim 32 wherein:

said pockets extend through said front and rear disc faces; and said holders are secured at the rear face of said disc.

34. The chipper disc and knife assembly in claim 32 wherein said pockets extend through said front and rear faces; and said assembly includes fastening means for securing said holders to said disc, said fastening means being removable at said disc rear face.

35. The chipper disc in claim 33 wherein:

said blades and said slots are tapered to cause a wedging sliding fit of said blades into said slots.

36. A wood chipping blade mounting assembly for attachment to a chipper disc at pockets therein, comprising:

a mounting body having means for enabling said body to be removably fastened to a chipper disc, said mounting body having a central portion for insertion into a chipper disc pocket;

said mounting body having a blade receiving and mounting portion for receiving a chipping blade while allowing a portion of the blade to project beyond said central portion for chipping wood; and means for retaining said blade to said blade receiving and mounting portion of said mounting body in a manner to cause said blade and said body to be mounted as a unit to said disc and removed as a unit from said disc.

37. The wood chipping blade mounting asssembly in claim 36 wherein said blade retaining means compries a socket and a wedging means adjacent said socket for wedging said blade into said socket.

38. The wood chipping blade mounting assembly in claim 37 wherein said wedging means includes threaded means for operating said wedging means.

39. The wood chipping blade mounting assembly in claim 38 wherein said threaded means includes a differential threaded fastener.

40. The wood chipping blade mounting assembly in claim 36 wherein said blade retaining means includes a threaded fastener.

41. The wood chipping blade mounting assembly in claim 36 wherein said blade retaining means comprises a blade receiving slide socket in said central portion of said mounting body; and said slide socket having tapered walls to interfit with a like tapered blade for retention of the blade.

42. The wood chipping blade mounting assembly in claim 40 wherein said threaded fastener has an axial opening extending therethrough from end to end to enable wood debris to be punched out, and has polygonal walls in at least a portion of said axial opening to enable a like shaped tool to be inserted for removal of said fastener.

43. The wood chipping blade mounting assembly in claim 42 wherein said mounting body has an orifice extending therethrough to receive said fastener, whereby wood debris punched out of said fastener will be punched out of said mounting body.

44. The wood chipping blade mounting assembly in claim 43 including a tapered threaded annular bushing received by said orifice and cooperative with said fastener to secure said fastener to said mounting body.

45. A disintegrator for stumps or the like comprising:

a receiving trough having first and second ends;

a rotatably mounted chipper disc at said first end of said trough;

drive means operably connnected to said chipper disc to rotate said disc about its axis;

a plurality of chipping blades at the face of said disc at varying radial locations thereof for chipping portions of stumps or the like forcibly fed to said disc;

stabilizer anvil means projecting radially inwardly adjacent said disc for stabilizing the stumps or the like;

a power ram at the second end of said trough, movable toward said disc, to force stumps or the like in said trough to said chipping disc; and an infeed spout around said disc and extending axially toward said ram, having a diameter substantially equal to the diameter of said disc.

* * * * *

UNITED STATES PATENT AND TRADEMARK OFFICE

CERTIFICATE OF CORRECTION

PATENT NO. : 4,736,781

DATED : April 12, 1988

INVENTOR(S) : Norval K. Morey and Ivor Bateman

It is certified that error appears in the above-identified patent and that said Letters Patent is hereby corrected as shown below: Title page:

Abstract, Line 16;

"substantilly" should be -- substantially --;

Column 13, Claim 29, Line 29;

"for" should be -- from --;

Column 13, Claim 30, Line 38;

"the" should be -- said --.

Signed and Sealed this

Sixth Day of December, 1988

*Attest:*

*Attesting Officer*

DONALD J. QUIGG

*Commissioner of Patents and Trademarks*